US007735510B1

(12) United States Patent
Carter

(10) Patent No.: US 7,735,510 B1
(45) Date of Patent: Jun. 15, 2010

(54) SLIDE AND FIT DAMAGE PREVENTOR FOR KITCHEN AND BATHROOM VANITIES

(76) Inventor: Frank L. Carter, 33776 Robles Dr., #E, Dana Point, CA (US) 92629

( * ) Notice: Subject to any disclaimer, the term of this patent is extended or adjusted under 35 U.S.C. 154(b) by 211 days.

(21) Appl. No.: 11/563,638

(22) Filed: Nov. 27, 2006

Related U.S. Application Data

(63) Continuation-in-part of application No. 11/420,710, filed on May 26, 2006.

(51) Int. Cl.
*F16K 23/00* (2006.01)

(52) U.S. Cl. ..... 137/312; 220/571

(58) Field of Classification Search ..... 137/312; 220/571

See application file for complete search history.

(56) References Cited

U.S. PATENT DOCUMENTS 3,304,950 A * 2/1967 Hubert ..... 137/312
4,369,532 A * 1/1983 Houchins et al. ..... 4/619
5,134,683 A * 7/1992 Powell ..... 392/449
5,224,508 A * 7/1993 Bates, Jr. ..... 137/312
5,389,036 A * 2/1995 Halley ..... 454/182
5,527,052 A * 6/1996 Litin ..... 220/571
5,675,854 A * 10/1997 Zibelin ..... 5/695
5,881,762 A * 3/1999 Janesky ..... 137/312
6,059,387 A * 5/2000 Echard et al. ..... 220/571
6,691,884 B1 * 2/2004 Dwyer ..... 220/571

* cited by examiner

*Primary Examiner*—Kevin L Lee
(74) *Attorney, Agent, or Firm*—David S. Nagy

(57) ABSTRACT

This is a leak pan device designed to prevent internal damage to cabinetry caused by faulty plumbing, and also by various kinds of construction debris. It is composed of two or more parts that fit adjustably together to form a pan that has a flat bottom and one or more raised edges to contain leakage, direct it in a prescribed course through a drain or depression in a raised edge, or both. The leak pan device is easily fitted and placed beneath plumbing under kitchen, bathroom and all other plumbing areas such that the leak pan contains leaking water thereby preventing damage including rotted wood, mold build-up and warped cabinet materials.

7 Claims, 4 Drawing Sheets

FIG. 1.
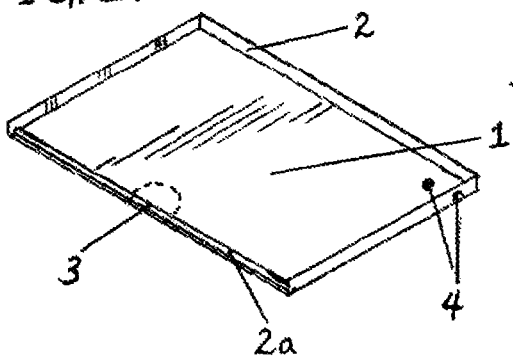
FIG. 2.
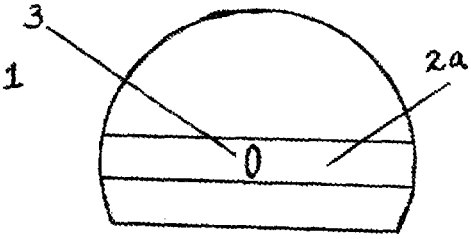
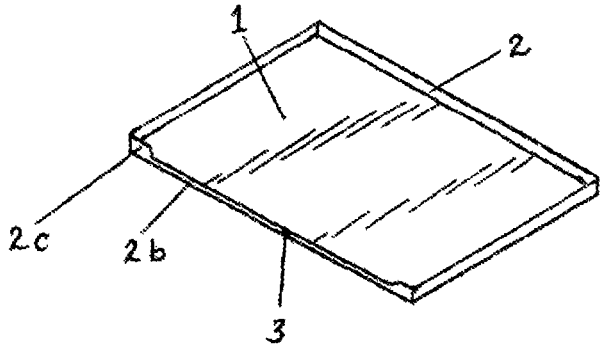
FIG. 3.
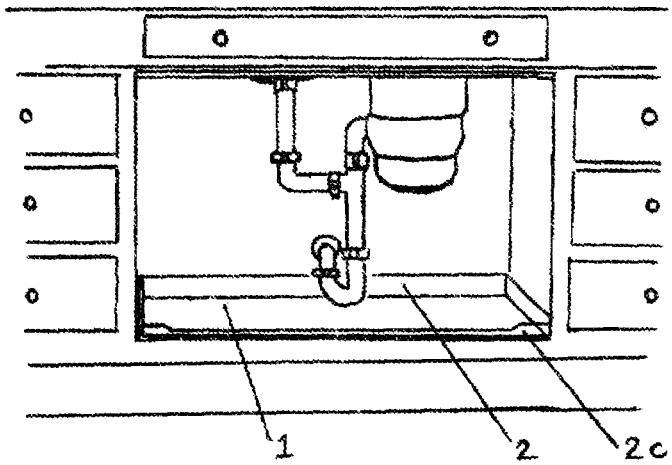
FIG. 4.

SLIDE AND FIT DAMAGE PREVENTOR FOR KITCHEN AND BATHROOM VANITIES

This application is a continuation-in-part of applicant's co-pending application U.S. Ser. No. 11/420,710, filed on May 26, 2006 and entitled "Sink and Vanity Base Protector", which application is now pending.

This invention is a leak pan device designed to prevent internal damage to cabinetry caused by faulty plumbing, and also by various kinds of construction debris. The leak pan device is easily fitted and placed beneath plumbing under kitchen, bathroom and all other plumbing areas such that the leak pan contains leaking water thereby preventing damage including rotted wood, mold build-up and warped cabinet materials. The present invention has many other preventative features that are disclosed herein. In addition, it features innovations that makes it fit a wide range of cabinet sizes.

BACKGROUND OF THE INVENTION

Areas under plumbing, in particular bathroom and kitchen sinks, are common areas of water leakage. This water leakage leads to countless problems including rotted wood, mold build-up and warped cabinet materials, odor release and rodent and insect attraction.

Nearly everyone has experienced one type of plumbing leak or another. The most common leak experienced is that under the bathroom and kitchen sink areas due to the frequency of use of such sinks. Bathroom and kitchen sink cabinets are normally designed and built from wood, often particularly water-sensitive pressed-wood or particle board. Unfortunately, such wood cabinets do not resist water but rather absorb it, with leakage thus resulting in damage to the wood. The most common damages are warping and mold build-up. Warping and mold build-up both require expensive replacement of the cabinetry. Additionally, water damage is not limited to wood cabinets but negatively affects all cabinet materials if left unattended. In addition, there are a number of different cabinet sizes produced by current manufacturers, which would ordinarily require different-sized leak pans to fit them; indeed, even nominally identically-sized cabinets may have differing interior dimensions.

The present invention will be invaluable to cabinet manufacturers, home building contractors and individuals already residing in completed homes. Contractors will especially benefit financially and maximize their profits since they will be relieved of liability for replacing damage to sink cabinets caused by initially overlooked plumbing leaks; furthermore, cabinets are often damaged by mortar and grout from sink and tile installation dripping down into the cabinetry, or similarly from dust and mud from drywall installation, and from other construction debris. Currently there is little in the way of products on the market that prevent water damage as set forth herein. Builders, contractors and/or homeowners are forced to replace their sink cabinets after they discover the water leakage problem too late or use some type of pot or pan to contain the leaking water from the faulty plumbing. None of these solutions is truly acceptable or comprehensive.

SUMMARY OF THE INVENTION

The present invention addresses and solves the aforementioned problems by conveniently containing water leaking from plumbing areas. The leak pan disclosed herein is intended to be adapted to any sink cabinets. The leak pan can also be checked routinely to locate leaks that may have otherwise gone undetected until too late.

The leak pan can be made from any number of materials, including, in a particularly ingenious version, from any of a range of materials which would have, like Gore-Tex® fabric, perforations or other voids large enough to permit the passage of gases and vapors, but small enough to prevent the passage of liquids, so that condensation or extraordinary leakage not caught by the pan would nevertheless be able to evaporate out from under the pan. However, in its preferred embodiment the leak pan is economically molded of sturdy plastic. The resultant sturdy leak pan has a reservoir of depth sufficient to contain water leaking over a considerable period of time. Additionally, the reservoir can be used to organize those items commonly stored under both bathroom and kitchen sinks.

The installation of the leak pan also allows the user the opportunity to routinely check for water leaks thereby preventing any damage prior to the detection of the leak. Without the leak pan in place, a leak may go undetected since a wood cabinet is going to absorb the water thereby hiding the leak until it is too late.

The adjustable feature of this invention allows a single product to be applicable to a wide range of cabinets.

BRIEF DESCRIPTION OF THE SEVERAL VIEWS OF THE DRAWINGS

FIG. 1 is a three-quarter overhead view of one embodiment of the invention.

FIG. 2 is a detail view of the dashed, semi-circular area in FIG. 1.

FIG. 3 is a three-quarter overhead view of another embodiment of the invention.

FIG. 4 shows the invention installed in a cabinet.

DETAILED DESCRIPTION OF THE INVENTION

Figure 8:
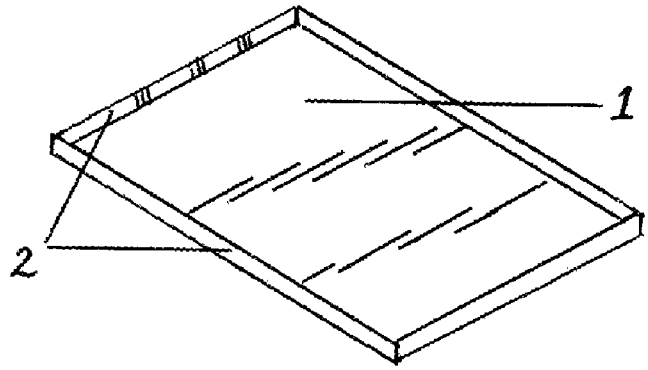
FIG. 8 is a three-quarter overhead view of yet another embodiment of the invention.
Figure 9:
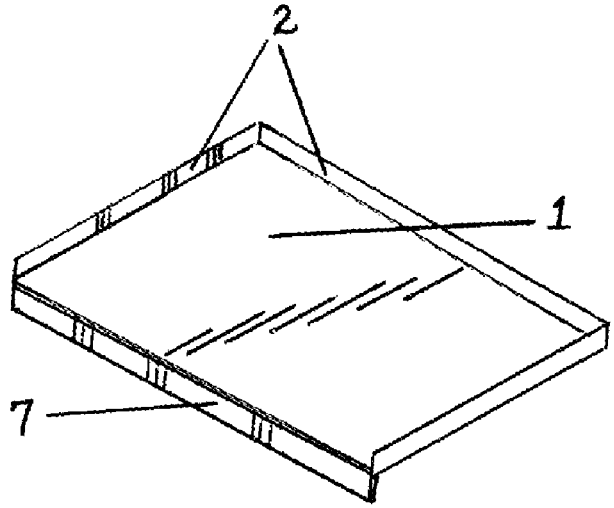
FIG. 9 is a three-quarter overhead view of yet another embodiment of the invention.
Figure 10:
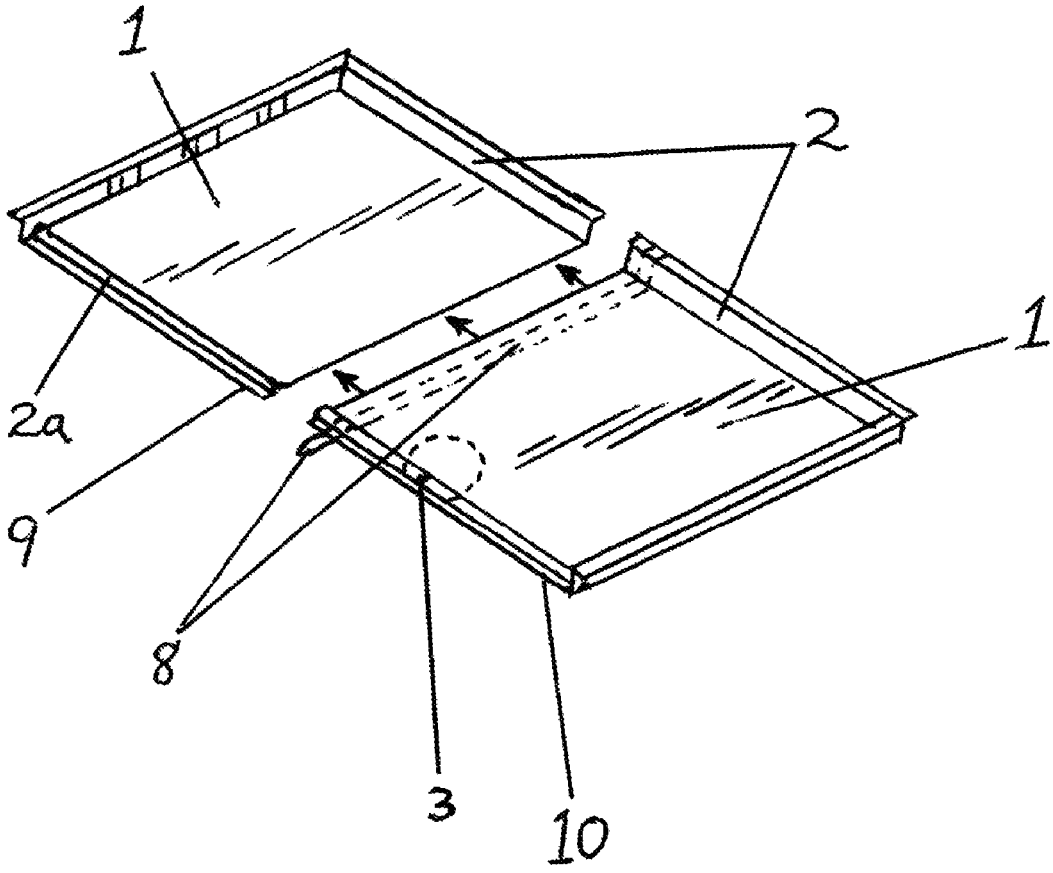
FIG. 10 is a three-quarter overhead view showing two parts, one of which slides and nests within the other.

This invention is a leak pan device designed to prevent internal damage to cabinetry by being capable of catching and retaining or safely diverting leaks, fluids and debris that might appear under a sink. It is a pan with a substantially flat bottom (1) and one or more raised edges (2)(2*a*). In its simplest form, as shown in FIG. 8, it is simply a pan with a flat bottom (1) and four identical side walls (2). Because commercial cabinetry, even units of nominally identical dimensions, exhibit variations in interior dimensions, the pan is made up of at least two parts sized so that one part slides snugly within the next (FIG. 10), allowing the parts to expand or contract to fit a wide variety of cabinet dimensions—while it will, in most cases, be most helpful to have the pan designed to expand and contract widthwise, there is no reason it cannot expand to fit cabinets of varying depths, instead. Where the parts mate, some sort of seal can be provided, such as a gasket or tape (8). Optimally, this pan is sized and adjusted to fit flush into the base of the surrounding cabinetry (FIG. 4). While these side walls are depicted as being vertical in relation to the horizontal bottom of the pan, it can be easily understood that such side walls might also advantageously angle outward to some degree— angling inward would, of course, make less sense in terms of catching leaks running down a wall of the cabinet. In addition, one or more walls—optimally the back wall in the widthwise-adjustable embodiment of FIG. 10—could be equipped with wall flanges (5) which, in addition to providing a more positive seal against the walls of the cabinet, could be made easily trimable, as described in this inventor's U.S. Pat. No. 6,412,638; this would allow the pan to fit cabinets of varying depths (or widths, if made to expand front-to-back).

In addition to having the base of the pan and its sides designed and adjusted to fit flush in a given cabinet, it may optionally be helpful to equip the sides, preferably at their tops, with some sort of flexible edge, such as a rubber bead or flange or squeegee strip (5), which can be compressed or bent to ensure an even tighter fit and seal against the sides of the cabinet so as to prevent any liquid from leaking down the sides of the cabinet past the pan.

Those skilled in the art will understand that there are numerous materials that can be utilized to mold the leak pan. The material and method disclosed herein are the preferred materials and methods respectively.

Figure 5:
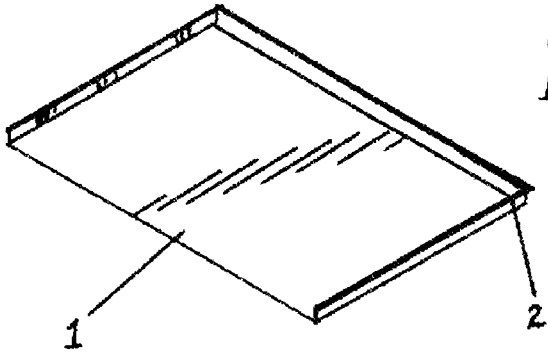
FIG. 5 is a three-quarter overhead view of yet another embodiment of the invention.
Figure 6:
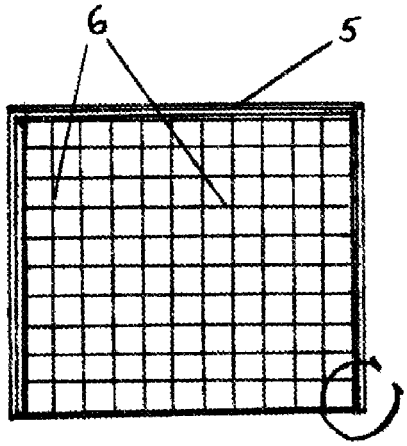
FIG. 6 is an overhead view of the invention.
Figure 7:
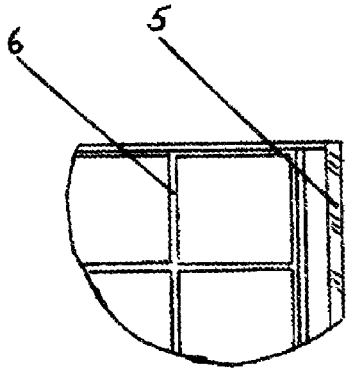
FIG. 7 is a detail view of the circled area in FIG. 6 showing a flexible flange.

Accordingly, in its preferred embodiment this slide & fit damage preventor for kitchen and bathroom vanities comprises two or more parts that nest, slide or otherwise fit together to create a pan with a substantially flat bottom surface (1), and four sides (2) continuously extending upward from the flat bottom surface creating a reservoir capable of containing liquids, sized so as to fit—ideally to fit snugly—the cabinet to be protected. It is recognized, however, that it may not be practical or desirable in every application to have regular walls on all four sides of the bottom (and, of course, this invention adapts easily to cabinets having other than the traditional four sides, such as round shapes, Buckminster Fuller-inspired polygons, etc.); for example, having a wall on the side of the tray at the front of a cabinet, where the cabinet's door opens, may present a lift-over annoyance when users place storage items into the cabinet. Thus, in place of a front wall, or indeed any of its walls, the pan could be equipped with a raised berm or lip (2*a*), flange (2*b*), ramp or any of a variety of other barriers that could still serve to contain spills and leaks. Additionally, for physical manufacturing reasons it may be advantageous, in an embodiment having side and back walls and a lower raised edge in front, to have the front raised edge be a "full height" wall (2*c*) where it joins each side wall, so as to strengthen the side walls, and then taper down to the lower height (2*b*) for ease of lift-over. For similar manufacturing reasons, it may also be advantageous to design the surfaces of the pan with raised ribs (6) for added strength with a minimum of additional material and weight. Of course, there is a trade-off in capacity versus convenience, in that diminishing the height of, say, the front barrier for ease of lift-over will also diminish the capacity of the pan for containing liquid. The greatest diminution of this capacity would be as shown in FIG. 5, where the pan lacks any sort of raised edge on one side.

Furthermore, it may be desirable to equip the pan with some sort of drain or channel to direct any liquid toward a "safe" location, such as a bathroom drain. This could be in the form of a hole in the pan or raised edge (4), connected to some sort of tube or trough to direct the liquid, or a breach or channel (3) in one or more sides or barriers. In particular, as in FIG. 3, this could take the form of having a lip (2*a*) at the cabinet-front edge of the pan provided with a gap, channel, nick or depression (3) to direct liquid out of the cabinet in a prescribed course. As a further variation on this theme, the cabinet-front edge of the pan could be equipped with a wall or flange that angles downward (7), thereby covering and protecting the front edge of the bottom of the cabinet from damage from any liquid directed out that way.

I claim:

1. A damage control leak pan consisting of two or more pieces that adjustably fit together to form a pan comprising:

a bottom surface, and one or more raised edges, creating a reservoir capable of containing and/or directing spills, drips or leakage, adjustable to fit surrounding cabinetry, wherein at least one of said one or more raised edges is provided with at least one depression to direct liquids in a prescribed course out of said pan and said cabinetry.

2. A damage control leak pan according to claim 1, wherein at least a part of the perimeter of said pan is equipped with one or more sides or flanges extending downward below the floor of said surrounding cabinetry, so as to protect said cabinetry from overflow or outflow of liquids.

3. A damage control leak pan according to claim 1, composed at least in part of a material that permits the passage of vapors but not liquids.

4. A damage control leak pan according to claim 1, wherein said pieces are equipped with outward-projecting flanges.

5. A damage control leak pan according to claim 4, wherein said outward-projecting flanges are trimable, so as to allow the pan to snugly fit into a variety of spaces.

6. A damage control leak pan according to claim 1, wherein said pieces are equipped with one or more gaskets, tapes, and/or other seals to make their adjustable fit watertight.

7. A damage control leak pan according to claim 1, wherein at least one of said one or more raised edges is equipped with a flexible gasket or squeegee-like surface to seal against a side or sides of said surrounding cabinetry.

* * * * *